US008523580B2

(12) United States Patent
Midorikawa et al.

(10) Patent No.: US 8,523,580 B2
(45) Date of Patent: Sep. 3, 2013

(54) ELECTRICAL CONNECTOR

(75) Inventors: Kazuya Midorikawa, Tokyo (JP); Masayuki Goto, Tokyo (JP); Tetsuya Ooi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 13/357,903

(22) Filed: Jan. 25, 2012

(65) Prior Publication Data

US 2012/0196486 A1 Aug. 2, 2012

(30) Foreign Application Priority Data

Feb. 1, 2011 (JP) ..... 2011-019581

(51) Int. Cl.
*H01R 12/00* (2006.01)

(52) U.S. Cl.
USPC ..... 439/74

(58) Field of Classification Search
USPC ..... 439/74, 660
See application file for complete search history.

(56) References Cited

U.S. PATENT DOCUMENTS 7,985,099 B2 * 7/2011 Wu ..... 439/626

FOREIGN PATENT DOCUMENTS

| | | |
|---|---|---|
| JP | 10-284197 A | 10/1998 |
| JP | 11-000099 U | 7/1999 |
| JP | 2009-117227 A | 5/2009 |

* cited by examiner

*Primary Examiner* — Phuong Dinh
(74) *Attorney, Agent, or Firm* — Kubotera & Associates LLC

(57) ABSTRACT

An electrical connector includes a housing and a plurality of terminals disposed in the housing. The housing includes a bottom wall and a protruding wall. The terminal includes a held portion for being held in the housing, a base portion, a transition portion, an elastic arm portion and a contact portion. The protruding wall includes a plurality of vertical wall portions and a displacement receiving recess. The housing has an opening penetrating the bottom wall at least at a lower side of the displacement receiving recess. The displacement receiving recess communicates with the opening. Further, the base portion and the transition portion of the terminal are situated outside of the displacement receiving recess.

6 Claims, 6 Drawing Sheets

ELECTRICAL CONNECTOR

BACKGROUND OF THE INVENTION AND RELATED ART STATEMENT

The present invention relates to an electrical connector.

A conventional electrical connector (a conventional connector) including a plurality of terminals held in a housing by being molded integrally is disclosed in Patent Reference. In Patent Reference, the housing of the connector includes a circumferential wall composed of a pair of sidewalls extending in a longitudinal direction thereof and a pair of end walls extending in a short direction or a direction perpendicular to the longitudinal direction.

The housing further includes a bottom wall provided at a lower end edge of the circumferential wall so as to cover a space surrounded by the circumferential wall from a lower direction and a protruding wall surrounded by the circumferential wall, extending in the longitudinal direction as well as protruding in an upper direction. A space is formed between the circumferential wall and the protruding wall opening in the upper direction as a receptacle recess portion for receiving a fitting portion of a mating connector.

Patent Reference Japanese Utility Model Publication No. 11-000099

In the conventional connector disclosed in Patent reference, the terminal is held in the housing at a position closer to the sidewall. The terminal includes an elastic arm portion at a free end portion thereof, extending along the protruding wall. The terminal includes a horizontal base portion, the elastic arm portion, a transition portion, a downward extending portion and a connecting portion. The horizontal base portion extends in the short direction of the housing along the bottom wall of the housing.

The transition portion is formed by being bent the horizontal base portion at a position closer to the protruding wall in the short direction. The elastic arm portion extends in the upper direction through the transition portion. The elastic arm portion includes a contact portion at an upper end thereof. The downward extending portion extends in the lower direction obliquely, from the horizontal base portion at a position closer to the sidewall in the short direction. The downward extending portion is held in the housing. The connecting portion extends horizontally from the downward extending portion to outside of the housing.

The protruding wall of the housing includes a terminal groove extending in a vertical direction and opening in the upper direction, on a side surface thereof. The terminal groove is situated where corresponding to the terminal in the longitudinal direction and accommodates the transition portion and the elastic arm portion of the terminal therein. The protruding wall further includes a vertical wall portion extending in the vertical direction on both ends thereof and between the terminal grooves next to each other, in the longitudinal direction. In addition, the bottom wall has a hole opening where corresponding to the terminal in the longitudinal direction and where being close to the protruding wall in the short direction thereof. The hole opening opens so as to penetrate the bottom wall in the vertical direction. The terminal groove communicates with outside of the connector through the hole opening.

The housing holds the terminal partially at a position closer to the sidewall of the horizontal base portion and at the downward extending portion with a boundary region between the sidewall and the bottom wall thereof by being molded integrally. The terminal groove of the housing accommodates the transition portion and the elastic arm portion of the terminal so as to have a space from a groove bottom surface of the terminal groove in the short direction. Thereby, the elastic arm portion is capable of elastic displacement by bending toward the groove bottom surface in the short direction.

The transition portion and the elastic arm portion are situated so as to have a space from inner side surfaces of the terminal groove in the short direction as well. The spaces generated between the surfaces of the terminal groove and the transition portion and the elastic arm portion of the terminal is quite narrow, since the terminal groove is partially occupied by the transition portion and the elastic arm portion.

In the conventional connector disclosed in Patent Reference, the bottom wall of the housing has the hole opening situated underneath of the transition portion and of a portion close to the protruding wall of the horizontal base portion. Therefore, the portion close to the protruding wall of the horizontal base portion and the transition portion are capable of elastic displacement in the lower direction as the horizontal base portion is bent. Accordingly, the transition portion is displaced elastically only in the lower direction while the elastic arm portion is displaced elastically toward both of the lower direction and the groove bottom surface as described above.

In the conventional connector disclosed in Patent Reference, when the housing and the terminal are molded integrally, it is normally assumed that an upper mold for providing the receptacle recess portion and the terminal groove of the housing is arranged from the upper direction, and a lower mold for providing the hole opening of the bottom wall of the housing is arranged from the lower direction. As described above, in the conventional connector in Patent Reference, the transition portion and the elastic arm portion of the terminal are situated in the terminal groove. In addition, the transition portion is not allowed to be displaced elastically toward the groove bottom surface of the terminal groove. Accordingly, the upper mold is not able to displace the transition portion so as to be apart from the groove bottom surface upon being molded integrally. Therefore, the space the transition portion and the elastic arm portion of the terminal generate against the terminal groove remains narrow. As a result, it is necessary that the upper mold has a portion being small enough to correspond to the space described above.

These days, downsizing of connectors is highly demanding. Accordingly, in general, the space described above in the longitudinal direction is often designed to be very narrow. Therefore, it is considerably difficult to manufacture the upper mold with the portion thereof as narrow as the space described above. In case that the upper mold is able to have the portion narrow enough to correspond to the space, the upper mold has a complicated shape, resulting in difficulty in production thereof and reducing strength of the portion thereof.

When the space is designed to be large enough to simplify the shape of the upper mold for the purpose of ease in manufacturing of the upper mold and of obtaining enough strength of the upper mold as retaining number of the terminal grooves and size of the housing in the longitudinal direction, in other words, density of the terminals, it is necessary to make the vertical wall portion narrower. As a result, the vertical wall portion reduces strength thereof. Accordingly, obtaining the upper mold with easier manufacturing process as well as maintaining the strength thereof and maintaining the strength of the vertical wall portion are contrary to each other. Furthermore, though both conditions are satisfied, it is not preferable to enlarge both of the space and the vertical wall portion in the longitudinal direction since the connector becomes larger in the longitudinal direction.

In view of the problems described above, an object of the present invention is to provide an electrical connector which enables both of the mold and the housing to maintain the strength thereof as well as simplifying the shape of the mold, without enlarging the connector in size in the longitudinal direction.

Further objects and advantages of the invention will be apparent from the following description of the invention.

SUMMARY OF THE INVENTION

In order to attain the objects described above, according to the present invention, an electrical connector (a connector) includes a housing and a plurality of terminals disposed in the housing. The housing includes a bottom wall and a protruding wall. The bottom wall faces a surface the connector is attached to, and extends in a direction the terminal is disposed as a longitudinal direction. The protruding wall for being connected to a mating connector extends in the longitudinal direction as well as extending in an upper direction from the bottom wall. The terminal is held in the housing by being molded integrally.

The terminal includes a held portion for being held in the housing, a base portion, a transition portion, an elastic arm portion and a contact portion. The elastic arm portion is provided at a closer position to the protruding wall of the terminal. The base portion combines the held portion and the elastic arm portion at a position closer to the bottom wall in a vertical direction. The elastic arm portion extends in the upper direction along the protruding wall from the base portion through the transition portion being bent. The elastic arm portion is capable of elastic displacement in a short direction perpendicular to the longitudinal direction. The contact portion for contacting with a mating terminal of the mating connector is provided at an upper end portion of the elastic arm portion.

The protruding wall of the housing includes a plurality of vertical wall portions and a displacement receiving recess. The vertical wall portion is disposed in the protruding wall with a space in the longitudinal direction. The displacement receiving recess is depressed between the vertical wall portions next to each other, from a position where a side surface of the vertical wall portion extending in the longitudinal direction and the vertical direction is situated. The displacement receiving recess allows the elastic arm portion of the terminal to be displaced elastically.

In the connector described above, in the present invention, the housing has an opening penetrating the bottom wall at least at a lower side of the displacement receiving recess. The displacement receiving recess communicates with the opening. Further, the base portion and the transition portion of the terminal are situated outside of the displacement receiving recess.

In the connector according to the present invention, the transition portion of the terminal is incapable of elastic displacement in the short direction and is situated outside of the displacement receiving recess. Therefore, when the housing and the terminal are molded integrally, an entire space of the displacement receiving recess in the longitudinal direction can be used for a lower mold without enlarging the displacement receiving recess in the longitudinal direction. Accordingly, the displacement receiving recess can be provided by placing the lower mold utilizing the entire displacement receiving recess from the lower direction. Consequently, it is possible to obtain the lower mold having a simple shape with sufficient strength and size as well as providing the displacement receiving recess by the lower mold.

In case the connector is designed so that the elastic arm portion is situated in the displacement receiving recess in a free state as the connector is manufactured completely, the transition portion incapable of elastic displacement is not situated in the displacement receiving recess. In addition, upon being molded integrally, the lower mold displaces the elastic arm portion toward outside of the displacement receiving recess elastically. Therefore, it is possible to place the lower mold without obstruction. The lower mold can be extracted in the lower direction after being molded integrally through the opening in the bottom wall.

Either of that the elastic arm portion in the free state is situated inside or outside of the displacement receiving recess, upon being molded, the elastic arm portion is always situated outside the displacement receiving recess, in other words, in a space around the protruding wall. Accordingly, an upper mold placed from the upper direction for providing the space is able to have a groove portion opening toward the protruding wall and corresponding to the elastic arm portion so that the groove portion surrounds the elastic arm portion from three directions without being obstructed by the displacement receiving recess. Therefore, it is possible to obtain the upper mold having a simple shape.

As described above, the elastic arm portion of the terminal is situated outside the displacement receiving recess. Accordingly, the elastic arm portion and an inner wall surface of the displacement receiving recess have a space therebetween as opposed to the conventional connector. Consequently, the upper mold is able to have the groove portion thereof larger in the longitudinal direction, than the space between the inner surface of the displacement receiving recess and the elastic arm portion in the conventional connector. Thereby, it is possible to maintain strength of the upper mold.

Further, as opposed to the conventional connector, it is not necessary that the upper mold has a portion corresponding to the space described above. Therefore, it is not necessary to shrink the vertical wall portion in the longitudinal direction as enlarging the upper mold in the longitudinal direction in order to obtain the sufficient strength. As a result, the vertical wall portion is able to obtain sufficient strength. In addition, the mold and the connector are able to be strong sufficiently without being enlarge in the longitudinal direction for. Therefore, it is possible to avoid the connector from growing in size.

It is preferable that the protruding wall of the housing includes a regulating protrusion protruding from a side surface of the vertical wall portion. A projecting portion of the regulating protrusion regulates a position of the mating connector in the short direction as the connector is connected to the mating connector. It is preferable that the regulating protrusion is smaller in size than the vertical wall portion in the longitudinal direction.

As described above, as the connector is connected to the mating connector, it is possible to regulate the position of the mating connector in the short direction with the regulating protrusion. Further, the regulating protrusion is smaller in size than the vertical wall portion in the longitudinal direction. Therefore, as compared to a case that the regulating protrusion is similar in size with the vertical wall portion, it is possible to maintain a sufficient interval between the regulating protrusion and the elastic arm portion of the terminal. Accordingly, it is possible to avoid a portion corresponding to the interval of the upper mold from becoming smaller in the longitudinal direction when the housing and terminal are molded integrally. As a result, it is possible to maintain the strength of the upper mold as well as simplifying the shape of the upper mold.

It is preferable that the regulating protrusion of the housing is provided in any two or more of the vertical wall portions, respectively. Thereby, the position of the mating connector is satisfactorily regulated by the regulating protrusions provided in the vertical wall at the two or more positions having a distance.

The regulating protrusion of the housing may be situated in the vertical wall portion at an end of the protruding wall in the longitudinal direction. When the regulating protrusion is only provided in the vertical wall portion at an end of the protruding wall in the longitudinal direction, it is possible to downsize the vertical wall portion without the regulating protrusion in the longitudinal direction as the vertical wall portion situated between the displacement receiving recesses adjacent to each other does not include the regulating protrusion. Consequently, it is possible to downsize the housing, eventually the connector, in the longitudinal direction. Furthermore, the regulating protrusions provided at both ends have a sufficient distance to each other. Accordingly, the mating connector is regulated the position thereof sufficiently though the regulating protrusion is provided only at two positions.

The regulating protrusion of the housing may be provided in the vertical wall portion between the displacement receiving recesses adjacent to each other as well as in the vertical wall portions at both ends of the protruding wall in the longitudinal direction. When the regulating protrusions are provided not only in the vertical wall portion at both end of the protruding wall in the longitudinal direction but also in the vertical wall portion between the displacement receiving recesses adjacent to each other, the mating connector is regulated the position thereof in the short direction more certainly. In addition, by sharing a force for regulating with many regulating positions, it is possible to reduce a stress each regulating protrusion receives.

The terminal is formed by bending a metal strip in a thickness direction thereof. It is preferable that the terminal is held in the bottom wall of the housing with the base portion thereof by being molded integrally. In addition, it is preferable that the terminal includes a tapered portion and the tapered portion is held in the bottom wall at a position corresponding thereto. The tapered portion is provided on both edges of the base portion and has a shape being narrower toward the protruding wall.

As the connector is connected to the mating connector, the contact portion of the elastic arm portion of the terminal is pushed by the mating terminal of the mating connector and the elastic arm portion is displaced elastically into the displacement receiving recess. Then the base portion receives an external force having a component toward the protruding wall in the short direction of the housing. Since the base portion of the terminal includes the tapered portion, the tapered portion wedges into the bottom wall holding the tapered portion at the position corresponding thereto toward the protruding wall. Thereby, it is possible to prevent the base portion from coming off from the bottom wall.

As described above, in the present invention, the transition portion incapable of elastic displacement in the short direction is situated outside the displacement receiving recess. Therefore, the lower mold is able to have the size utilizing the displacement receiving recess entirely in the longitudinal direction. Thereby, it is possible to obtain the lower mold having a simple shape with the sufficient strength. Further, the upper mold is able to have the groove portion corresponding to the elastic arm portion and surrounding the elastic arm portion from three directions without being obstructed by the displacement receiving recess. In addition, the groove portion is able to be larger in size than the space between the inner surface of the displacement receiving recess and the elastic arm portion. Consequently, it is possible to maintain the strength of the upper mold.

Further, as opposed to the conventional connector, it is not necessary that the upper mold has the portion corresponding to the space described above. Therefore, it is not necessary to enlarge the upper mold in the longitudinal direction in order to obtain the sufficient strength. Furthermore, it is not necessary to shrink the vertical wall portion in the longitudinal direction. As a result, the housing is able to obtain a sufficient strength. In addition, it is not necessary to enlarge the mold and the housing in the longitudinal direction in order to obtain sufficient strength. Therefore, it is possible to avoid the connector from growing in size.

BRIEF DESCRIPTION OF THE DRAWINGS

FIGS. 5(A) and 5(B) are sectional views showing a state when molds are placed so that a terminal and a housing are molded integrally, wherein FIG. 5(A) is the sectional view taken where the terminal is situated and FIG. 5(B) is the sectional view taken where a regulating protrusion of the housing is situated.

DETAILED DESCRIPTION OF THE PREFERRED EMBODIMENTS

Hereunder, embodiments of the present invention will be explained with reference to the accompanying drawings.

First Embodiment

[Configuration of Connector]

Figure 1:
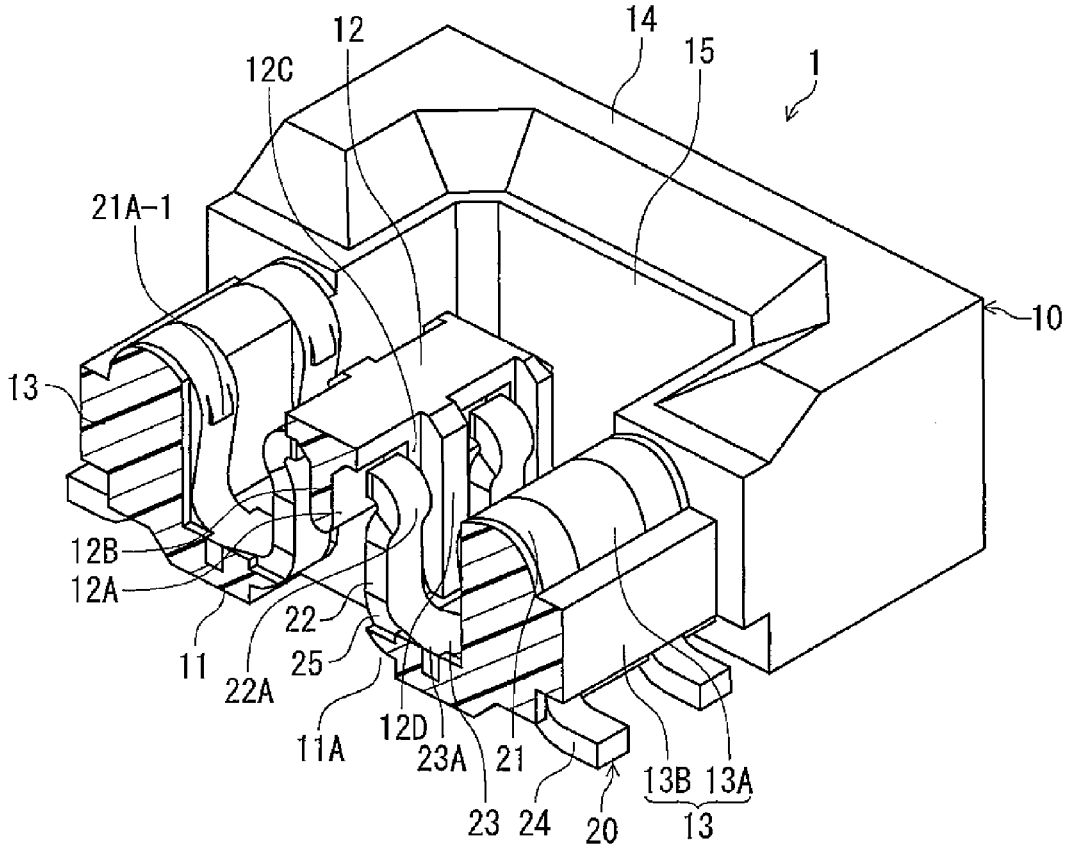
FIG. 1 is a perspective view showing an electrical connector with a cross sectional surface perpendicular to a longitudinal direction thereof, according to a first embodiment of the present invention.
Figure 2:
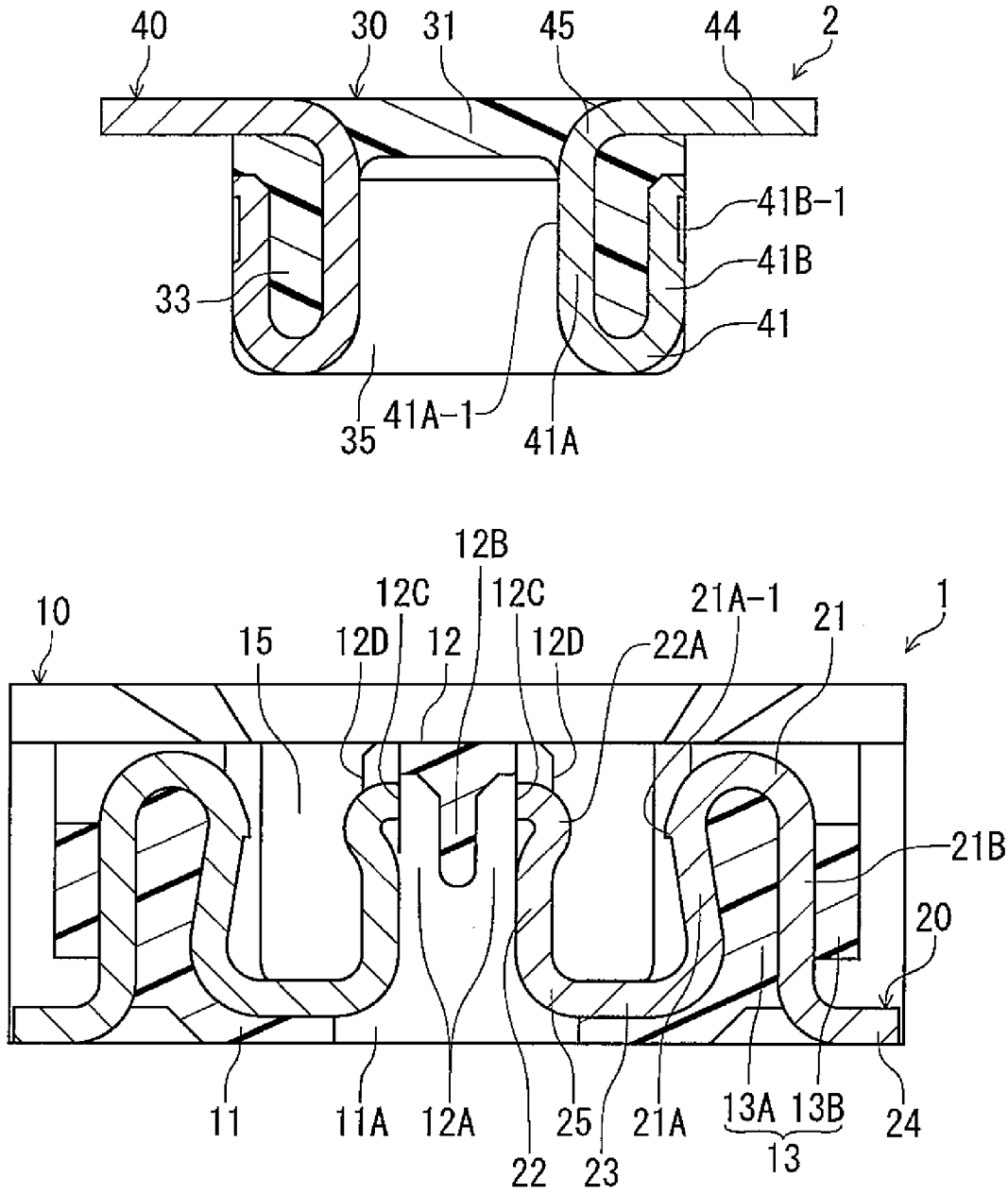
FIG. 2 is a sectional view showing the electrical connector in FIG. 1 and a mating connector with the same cross sectional surface in FIG. 1.
Figure 3:
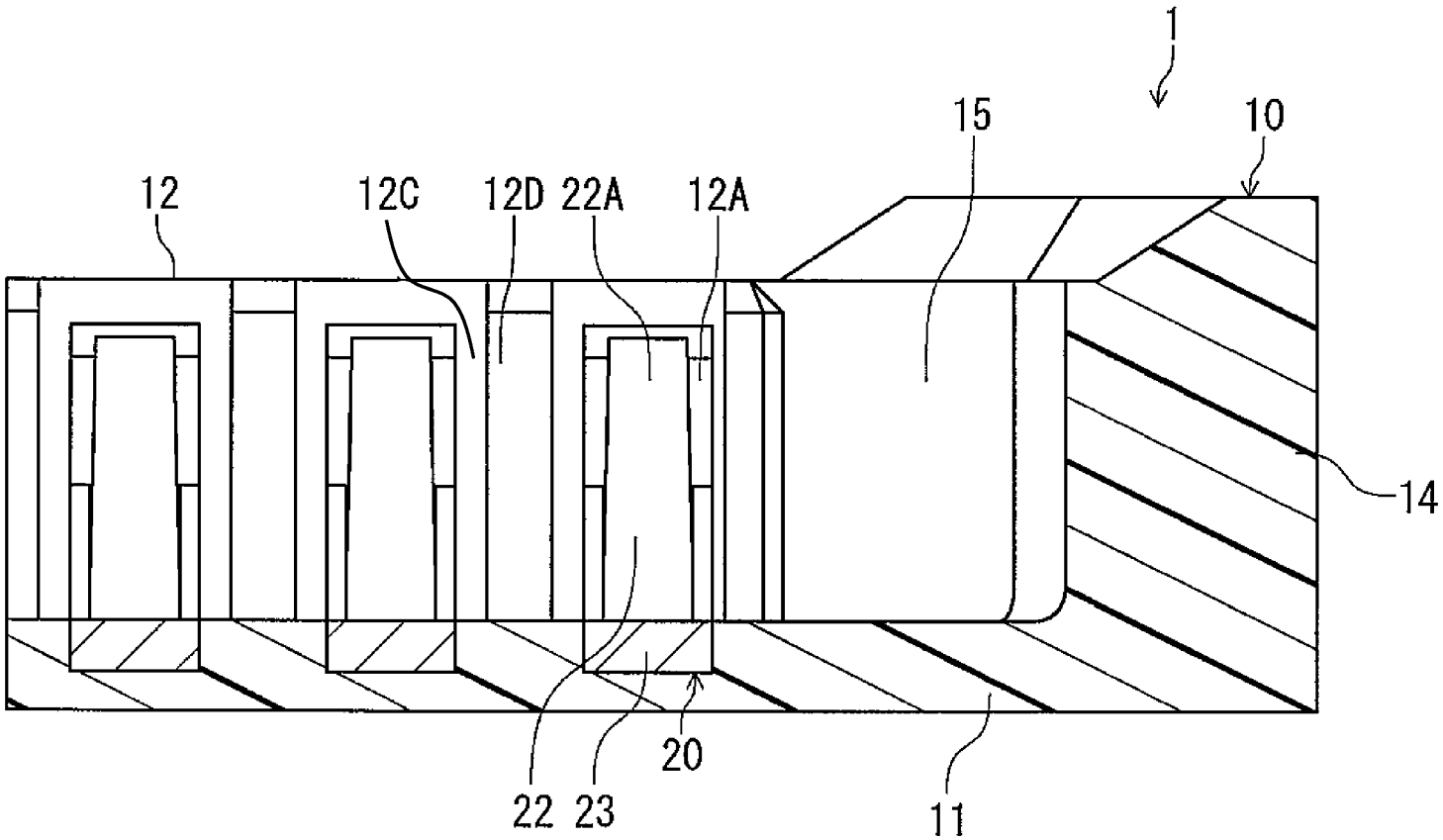
FIG. 3 is a sectional view partially showing the electrical connector in FIG. 1 taken along a surface perpendicular to a short direction thereof.
Figure 4:
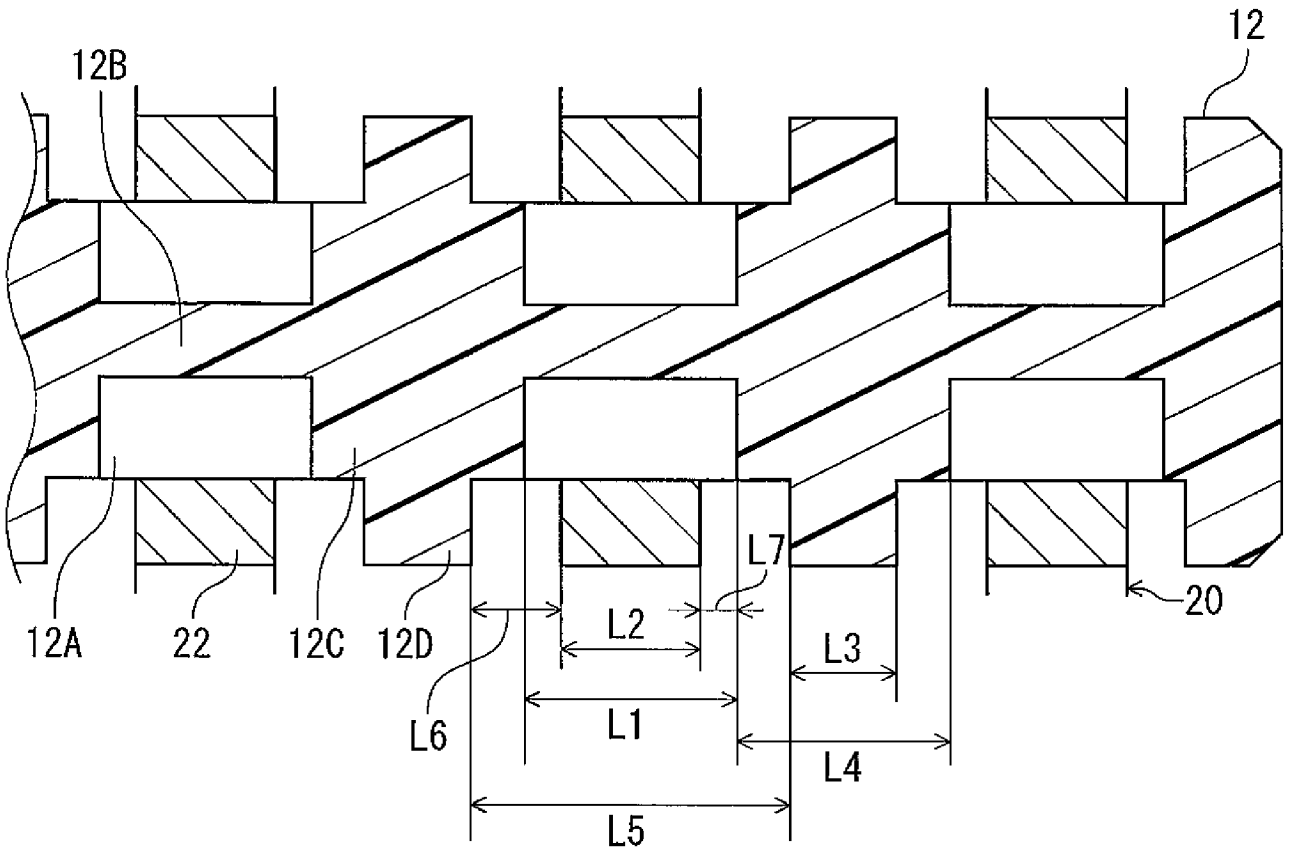
FIG. 4 is an enlarged sectional view partially showing the electrical connector in FIG. 1 around a protruding wall 12 thereof from an upper direction.

FIG. 1 is a perspective view showing an electrical connector with a cross sectional surface perpendicular to a longitudinal direction thereof according to a first embodiment. FIG. 2 is a sectional view showing the electrical connector in FIG. 1 and a mating connector unconnected to the connector. FIG. 3 is a sectional view showing the electrical connector in FIG. 1 taken along a surface perpendicular to a short direction thereof and where a base portion of a terminal is situated. And FIG. 4 is an enlarged sectional view showing the electrical connector in FIG. 1 around a protruding wall 12 thereof from an upper direction.

The electrical connector 1 (the connector 1) according to the embodiment is mounted on a circuit board (not shown) and receives the mating connector 2 to be connected from the upper direction. The connector 1 includes a housing 10 and a plurality of the terminals 20. The plurality of the terminals 20 are made from metal and disposed to be held in the housing 10 in a longitudinal direction of the housing 10.

As shown in FIG. 1, the housing 10 includes a bottom wall 11, a protruding wall 12 and a circumferential wall surrounding the protruding wall 12. The bottom wall 11 faces a mounting surface of the circuit board and extends in the longitudinal direction, in other words, a terminal disposing direction. The protruding wall 12 protrudes from the bottom wall 11 in the upper direction and extends in the longitudinal direction. The circumferential wall includes a pair of sidewalls 13 facing each other and extending in the longitudinal direction and a pair of end walls 14. The end wall 14 connects to end portions of the two sidewalls 13 and extends in the short direction which is perpendicular to the longitudinal direction. The circumferential wall and protruding wall 12 forms a receptacle recess portion 15 having an annular rectangle shape for receiving a fitting portion of the mating connector 2.

The protruding wall 12 includes a plurality of vertical wall portions 12C. The vertical wall portion 12C is arranged with an equal interval in the longitudinal direction on a surface of the protruding wall 12 facing an inner wall surface of the sidewall 13. The vertical wall portion 12C extends in a vertical direction. The protruding wall 12 forms a displacement receiving recess 12A next to the vertical wall portions 12C. The displacement receiving recess 12A has a recessed shape from the vertical wall portion 12C and receives an elastic displacement of an elastic arm portion 22 of a terminal 20, as described later.

As shown in FIGS. 1 and 2, the displacement receiving recess 12C is formed on both side surface of the protruding wall 12. The displacement receiving recess 12C on each of the side surfaces is separated in the short direction (a horizontal direction in FIG. 2) by a separating wall portion 12B at an upper portion thereof. The separating wall portion 12B extends from an upper end of the protruding wall 12 in a lower direction. The displacement receiving recess 12A opens in a groove-like shape in an upper portion of the protruding wall 12 and conjoins in the short direction in a lower portion thereof.

As shown in FIGS. 3 and 4, an inner width of the displacement receiving recess 12A (L1 in FIG. 4) is wider than a width of the elastic arm portion 22 of the terminal 22 (L2 in FIG. 4). Therefore, the elastic arm portion 22 is allowed to be easily displaced elastically toward the displacement receiving recess 12A in the short direction.

As shown in FIGS. 1, 3 and 4, the vertical wall portion 12C has facing surfaces facing each other, being parallel to each other and perpendicular to the longitudinal direction. The facing surfaces of the vertical wall portion 12C and a side surface of the separating wall portion 12B form groove-like shape in the upper portion of the displacement receiving recess 12A.

The protruding wall 12 includes a regulating protrusion 12D. The regulating protrusion 12D protrudes from the vertical wall portion 12C and extends in the vertical direction. As shown in FIGS. 3 and 4, the regulating protrusion 12D has a width (L3 in FIG. 4) narrower than a width of the vertical wall portion 12C (L4 in FIG. 4). A projecting portion of the regulating protrusion 12D abuts against the fitting portion of the mating connector 2 in the short direction of the housing 10 as the connector 1 connects to the mating connector 2. Therefore, the regulating protrusion 12D regulates a position of the mating connector 2 in the short direction. As a result, it is possible to prevent the elastic arm portion 22 of the terminal 20 from being damaged, due to displacement thereof caused by being pressed excessively by a mating terminal 40.

Further, in the embodiment, the regulating protrusion 12D is situated between the elastic arm portions 22 of the terminals 20 next to each other. Accordingly, it is possible to prevent the elastic arm portions 22 of the terminals 20 next to each other from contacting with each other by being deformed, even though the mating connector 2 is twisted in the longitudinal direction inadvertently as the mating connector 2 is extracted.

In addition, as shown in FIGS. 1 and 3, an upper end of the regulating protrusion 12D is situated upper than an upper end of the elastic arm portion 22. Therefore, when the mating connector 2 is placed irregularly in the short direction as the connector 1 is connected to the mating connector 2, the mating connector 2 abuts against the upper end of the regulating protrusion 12D first. Accordingly, it is possible to prevent the elastic arm portion 22 from being damaged by being buckled and the like, due to an abutment by the mating connector 2 to the upper end of the elastic arm portion 22 as the connector 1 is connected to the mating connector 2.

As shown in FIGS. 1 and 2, a hole opening 11A is formed so as to penetrate the bottom wall 11. The hole opening 11A is opened where the terminal 20 is situated in the longitudinal direction in the bottom wall 11. As described later, the hole opening 11A allows a lower mold P1 (refer to FIGS. 5(A) and 5(B)) to be extracted in the lower direction after an injected resin is solidified as the housing 10 and the terminal 20 are molded integrally. The hole opening 11A is formed in a central portion of the housing 10 in the short direction and in a region where the protruding wall 12 is included. The hole opening 11A communicates with the displacement receiving recess 12A. In the embodiment, the hole opening 11A is formed in the region where the protruding wall 12 is included. The hole opening 11A may be formed at least where corresponding to the displacement receiving recess 12A in the short direction.

As shown in FIGS. 1 and 2, the sidewall 13 includes a main sidewall 13A and a secondary sidewall 13B. The main sidewall 13A is a main portion of the sidewall 13 extending in the longitudinal direction and in the vertical direction. The secondary sidewall 13B extends in the longitudinal direction along an outer surface of the main sidewall 13A and protrudes outward from the main wall portion 13A. As described later, the main sidewall 13A holds an entire portion of a held portion 21 having an upside-down U-shape of the terminal 20. Further, the secondary sidewall 13B holds the held portion 21 at a portion thereof situated outside.

The terminal 20 is formed by bending a metal strip in a thickness direction thereof into an approximate S-shape. The terminals 20 are arranged in the housing 10 forming two rows so as to be symmetrical about the protruding wall 12. The terminal 20 includes the held portion 21, the elastic arm portion 22, the base portion 23 and a connecting portion 24. The held portion 21 has the upside-down U-shape and is held by the sidewall 13 of the housing 10. The elastic arm portion 22 extends in the vertical direction at a position close to the protruding wall 12 in the short direction and includes a free end. The base portion 23 is held by the bottom wall 11 of the housing 10. Further, the base portion 23 extends in the short direction and connects one leg portion of the held portion 21 (an inner leg portion 21A, described later) to the elastic arm portion 22. The connecting portion 24 extends from another leg portion of the held portion 21 (an outer leg portion 21B, described later) to outside the housing 10. The connecting portion 24 is soldered to a corresponding circuit portion on the circuit board (not shown). As shown in FIGS. 1 and 2, the terminal 20 is held by being molded integrally with the housing 10 at the held portion 21 and the base portion 23 thereof.

In the embodiment, the terminal is held by the sidewall and the bottom wall of the housing. Configurations of holding the terminal are not limited to the case described above. For example, the terminal may be held by the bottom wall only when the connector does not have the sidewall.

The elastic arm portion 22 extends in the upper direction along the protruding wall 12 thorough a transition portion 25 made by being bent. The elastic arm portion 22 is capable of elastic displacement in the short direction by being bent in the thickness direction thereof. The elastic arm portion 22 includes a contact portion 22A having a convex curved shape toward the sidewall 13 at the free end portion of an upper end portion thereof. As described later, the contact portion 22A contacts with the mating terminal 40 of the mating connector 2. As shown in FIG. 2, when the elastic arm portion 22 is in a free state, the elastic arm portion 22 and the transition portion 25 are situated outside the displacement receiving recess 12A of the housing 10. Further, the contact portion 22A protrudes from the regulating protrusion 12D of the housing 10 at a top of the convex curved portion thereof.

As shown in FIG. 2, the held portion 21 has the upside-down U-shape as described above and includes the inner leg portion 21A and the outer leg portion 21B. The inner leg portion 21A extends along an inner surface of the main sidewall 13A and the outer leg portion 21B extends along an outer surface of the main sidewall 13A. The inner leg portion 21A includes a locking portion 21A-1 at a position close to an upper end thereof. The locking piece 21A-1 protrudes into the receptacle recess portion 15 so as to face the contact portion 22A.

As shown in FIG. 1, the locking portion 21A-1 is provided, for example, by embossment and the like. The locking portion 21A-1 has a width narrower than a width of the inner leg portion 21A. The locking portion 21A-1 keeps the connector 1 and the mating connector 2 connected to each other by engaging a locked portion 41B-1 of the mating terminal 40 of the mating connector 2, as well as helping the contact portion 22A by contacting and conducting electrically with the locked portion 41B-1.

As shown in FIGS. 1 and 2, the held portion 21 is held over the main sidewall 13A by being molded integrally. The held portion 21 contacts with the main sidewall 13A at an inner surface and side edges thereof. An outer surface of the held portion 21 being exposed from the main sidewall 13A is situated so as to form one smooth surface with an outer surface of the main sidewall 13A. The held portion 21 is also held in the sidewall 13 as the main sidewall 13A and the secondary sidewall 13B sandwich the outer leg portion 21B thereof.

As shown in FIG. 1, the base portion 23 includes a tapered portion 23A protruding from both end edges thereof and having a shape being narrower toward the protruding wall 12. The tapered portion 23A is situated at a middle portion of the base portion 23 in the short direction. The base portion 23 is held in the bottom wall 11 of the housing 10. An upper surface of the base portion 23 is situated in the same height with an upper surface of the bottom wall 11. Further, the base portion 23 exposes the upper surface thereof in the receptacle recess portion 15. The connecting portion 24, as shown in FIGS. 1 and 2, is situated in the same height with a lower surface of the bottom wall 11 and capable of being soldered to the corresponding circuit portion on the circuit board.

As shown in FIG. 4, as described above, the inner width of the displacement receiving recess 12A in the longitudinal direction (L1) is wider than the width of the elastic arm portion 22 of the terminal 22 (L2). In addition, the regulating protrusion 12D has the width (L3) narrower than the width of the vertical wall portion 12C (L4) in the longitudinal direction. Therefore, a distance between two regulating protrusions next to each other in the longitudinal direction (L5) is longer than L1. Accordingly, a distance between the elastic arm portion 22 and regulating protrusion 12D (L6) is longer than a distance between the elastic arm portion 22 and an inner wall surface of the displacement receiving recess 12A (L7) in the longitudinal direction.

[Manufacturing Process of Connector]

Figure 5A:
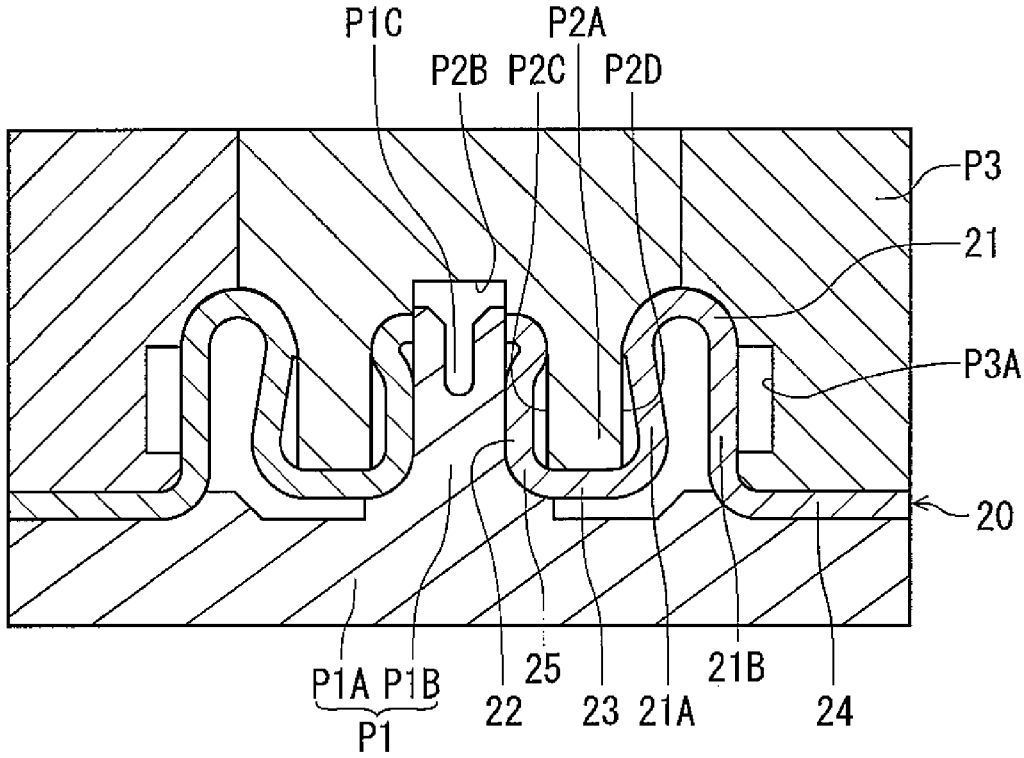
Figure 5B:
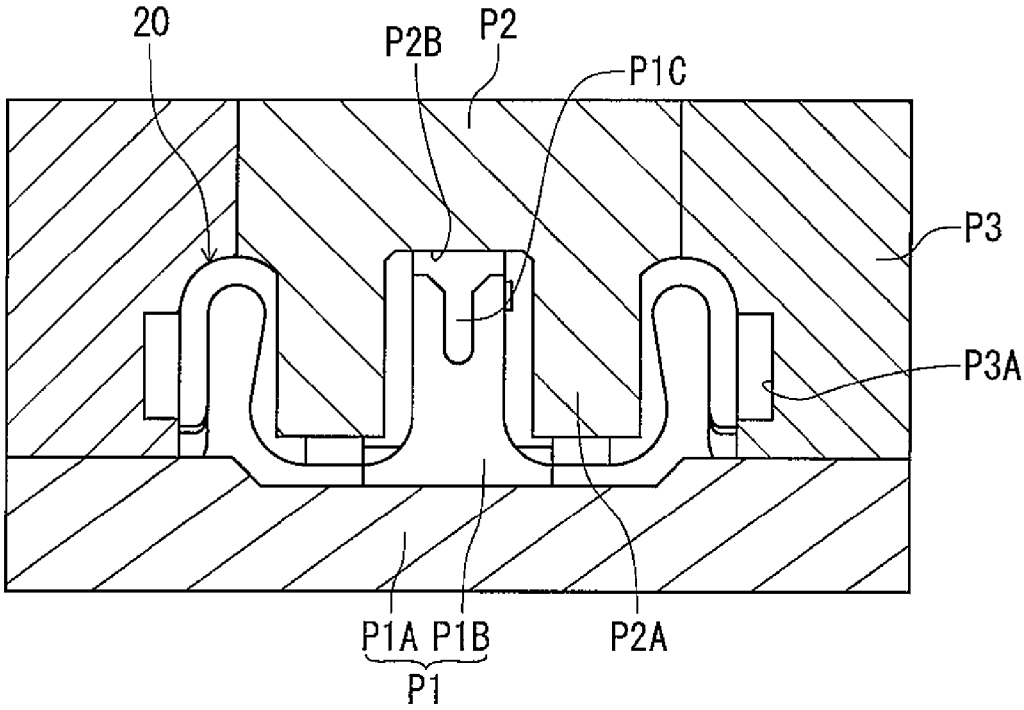

The connector 1 is manufactured as following. FIGS. 5(A) and 5(B) are sectional views showing a state when molds are placed so that the terminal 20 and the housing 10 are molded integrally, wherein FIG. 5(A) is the sectional view taken where the terminal 20 is situated and FIG. 5(B) is the sectional view taken where a regulating protrusion 12D is situated.

First, as shown in FIGS. 5(A) and 5(B), the terminal 20 is arranged on a predetermined position of the lower mold P1 so as to be symmetrical in the short direction (a horizontal direction in FIGS. 5(A) and 5(B)) of the housing 10. Then an upper mold P2 and a side mold P3 are placed from the upper direction and a side direction (a right side or a left side in FIGS. 5(A) and 5(B)), respectively. The upper mold P2, the side mold P3 and the lower mold P1 are placed so as to surround the terminal 20. Next, the housing 10 is formed by solidifying the resin injected in a liquid form and filled up into a space between the molds through an inlet (not shown). As a result, the housing 10 and the terminal 20 are molded integrally and thereby manufacturing of the connector 1 is completed. After the connector 1 is manufactured, the lower mold P1 is extracted in the lower direction through the hole opening 11A of the bottom wall 11 of the housing 10. The upper mold P2 and the side mold P3 are extracted in the upper direction and the side direction, respectively.

The lower mold P1 and the upper mold P2 mainly form the bottom wall 11, the protruding wall 12 and the main sidewall 13A. The side mold P3 mainly forms the secondary sidewall 13B. As shown in FIG. 5(A), the lower mold P1 includes a base portion P1A having a plate-like shape and a projecting portion P1B projecting from the base portion P1A. The projecting portion P1B is situated in a middle portion of the base portion P1A in the short direction (the horizontal direction in FIG. 5(A)). The projecting portion P1B opens a space including the displacement receiving recess 12A in the protruding wall 12. Therefore, the projecting portion P1B has a width (in other words, a size thereof in a direction perpendicular to a sheet surface of FIG. 5(A)) same as the width of the displacement receiving recess 12A. The lower mold P1 further includes a recessed portion P1C in an upper portion of projecting portion P1B. The recessed portion P1C corresponds to the separating wall portion 12B of the protruding wall 12.

As shown in FIGS. 5(A) and 5(B), the upper mold P2 includes a frame-like portion corresponding to the receptacle recess portion 15. The frame-like portion includes a wall portion P2A extends in the longitudinal direction. Further, the upper mold P2 includes a recessed portion P2B corresponding to the protruding wall 12. The recessed portion P2B is provided between the two wall portions P2A.

Further, as shown in FIG. 5(A), the wall portion P2A includes an inner groove portion P2C and an outer groove portion P2D in an inner surface thereof and an outer surface thereof, respectively. The inner groove portion P2C and the outer groove portion P2D are situated at positions corresponding to the terminal 20 in the longitudinal direction. The inner groove portion P2C is recessed so as to correspond to the elastic arm portion 22 and the transition portion 25 of the terminal 20. The outer groove portion P2D is recessed so as to correspond to the inner leg portion 21A of the held portion 21. The inner groove portion P2C opens toward the protruding wall 12 and surrounds the elastic arm portion 22 from other three directions upon being molded integrally. The outer groove portion P2D opens toward an opposite direction of the protruding wall 12 and surrounds the inner leg portion 21A of the held portion 21 from other three directions upon being molded integrally.

As shown in FIG. 5(A), the side mold P3 includes a recessed portion P3A at a position corresponding to the terminal 20 in the side surface thereof in the longitudinal direction. The recessed portion P3A is recessed so as to correspond to the held portion 21 of the terminal 20. The recessed portion P3A is recessed further so as to correspond to the secondary sidewall 13B in a range of the sidewall 13 in the longitudinal direction.

As shown in FIG. 2, according to the embodiment, the elastic arm portion 22 and the transition portion 25 of the terminal 20 of the connector 1 are not situated in the displacement receiving recess 12A. Therefore, an entire region of the width of the displacement receiving recess 12A is able to use for the lower mold P1. Therefore, the displacement receiving recess 12A is formed by placing the lower mold P1 with the projecting portion P1B being formed with a width of the entire region of the width of the displacement receiving recess 12A (L1 in FIG. 4) from the lower direction. Consequently, it is possible to obtain the lower mold P1 having a sufficient size (width) and strength.

According to the embodiment, the elastic arm portion 22 and the transition portion 25 of the terminal 20 of the connector 1 are not situated in the displacement receiving recess 12A. When only the transition portion 25 is not situated in the displacement receiving recess 12A, in other words, the elastic arm portion 22 is in the free state and situated in the displacement receiving recess 12A, it is also possible to manufacture the connector using the molds P1 and P3.

Accordingly, when the elastic arm portion 22 is in the free state and situated in the displacement receiving recess 12A, the lower mold P1 provided from the lower direction displaces the elastic arm portion 22 elastically toward outside the displacement receiving recess 12A upon being molded integrally. As a result, the elastic arm portion 22 allows the lower mold P1 to be placed. Therefore, the lower mold P1 can be placed when the transition portion 25 is not situated in the displacement receiving recess 12A regardless where the elastic arm portion 22 is situated.

Further, in the embodiment, the elastic arm portion 22 is not situated in the displacement receiving recess 12A, in other words, the elastic arm portion 22 is situated in the receptacle recess portion 15. Therefore, the upper mold P2 is able to have the inner groove portion P2C corresponding to the elastic arm portion 22 with a shape surrounding the elastic arm portion 22 from three sides and having an opening toward the protruding wall 12. As a result, the upper mold P2 is able to have a simple shape.

Furthermore, in the embodiment, the elastic arm portion 22 is not situated in the displacement receiving recess 12A. Accordingly, unlike the conventional connectors, the elastic arm portion 22 is situated in an open space without being surrounded by the inner wall surfaces of the displacement receiving recess. Therefore, the inner groove portion P2C of the upper mold P2 is able to have a width (L6 in FIG. 4) larger than the distance between the elastic arm portion 22 and an inner wall surface of the displacement receiving recess 12A (L7 in FIG. 4). As a result, it is possible to obtain the upper mold P2 having a simple shape and sufficient strength.

In addition, in the embodiment, the upper mold P2 does not need to have a portion corresponding to the distance described above unlike the conventional connectors. Therefore, it is not necessary to narrow the width of the vertical wall portion 12C in the longitudinal direction as it is not necessary for the portion described above of the upper mold P2 to be wide enough in order to obtain sufficient strength. As a result, it is possible to maintain strength of the vertical wall portion 12C. Further, it is possible to prevent the connector 1 from being larger, since the molds and the housing 10 are able to obtain sufficient strength without being larger in the longitudinal direction.

[Configuration of Mating Connector]

The mating connector 2 shown in FIG. 2 is attached to a circuit board (not shown). The mating connector 2 includes the fitting portion having a frame-like shape and corresponding to the receptacle recess portion 15 of the connector 1. The mating connector 2 is connected to the connector 1 as the fitting portion is fitted into the receptacle recess portion 15. As shown in FIG. 2, the mating connector 2 includes a housing 30 and a plurality of terminals 40 (mating terminals 40). The housing 30 has a substantial rectangular parallelepiped shape and made from a synthetic resin. The mating terminal 40 is arranged and held in the housing 30 in the longitudinal direction of the housing 30 by being molded integrally.

The housing 30 includes a bottom wall 31 facing the circuit board and a circumferential wall rising from the bottom wall 31. The mating connector 2 further includes a receptacle recess portion 35 surrounded by the bottom wall 31 and the circumferential wall. The receptacle recess portion 35 has an opening toward the lower direction as shown in FIG. 2. Upon being connected to the connector 1, the receptacle recess portion 35 receives the protruding wall 12 of the housing 10 of the connector 1 therein. The circumferential wall includes a pair of sidewalls 33 facing each other and extending in the longitudinal direction. The mating terminal 40 is disposed and held in the sidewall 33.

The mating terminal 40 is made by bending a metal strip in a thickness direction thereof and held in the housing 30 being arranged in two rows in a short direction (a horizontal direction in FIG. 2) of the housing 30 so as to be symmetrical. The mating terminal 40 includes an engaging portion 41, an inner leg portion 41A, a transition portion 45 and a connecting portion 44. The engaging portion 41 has a U-shape and the inner leg portion 41A is one of two leg portions of the engaging portion 41 situated closer to the receptacle recess portion 35. The connecting portion 44 extends in the short direction from the transition portion 45 being formed by being bent. The connecting portion 44 is soldered to a corresponding circuit portion of the circuit board. As shown in FIG. 2, the mating terminal 40 is held in the housing 30 by being molded integrally with the engaging portion 41 and the transition portion 44 thereof.

The engaging portion 41 is buried in the sidewall 33 so as to stride over the sidewall 33 from the lower direction. The sidewall 33 holds side edges and an inner surface of the engaging portion 41. An outer surface of the engaging portion 41 exposing from the sidewall 33 forms a smooth surface with an outer plate surface of the sidewall 33. The engaging portion 41 has a slightly larger size in the short direction (the horizontal direction in FIG. 2) than a distance between the contact portion 22 and the locking portion 12A-1 of the terminal 20 of the connector 1.

The engaging portion 41 includes a corresponding contact portion 41A-1 on the outer plate surface closer to the receptacle recess portion 35 of the inner leg portion 41A thereof. The corresponding contact portion 41A-1 is provided at a position closer to the bottom wall 31. The corresponding contact portion 41A-1 contacts with the contact portion 22A of the terminal 20 of the connector 1 with contact pressure, as the connector 1 and the mating connector 2 are connected to each other. The engaging portion 41 further includes the locked portion 41B-1 with a recessed shape provided at a position closer to the bottom wall 31 (an upper side in FIG. 2) on an outer surface of an outer leg portion 41B. The outer leg portion 41B is one of the two leg portions of the engaging portion 41 situated distant to the receptacle recess portion 35. The locked portion 41B engages the locking portion 21A-1 of the terminal 20.

As shown FIG. 2, the connecting portion 44 is situated approximately in the same height with a lower surface (an upper surface in FIG. 2) of the bottom wall 31. The connecting portion 44 is capable of being soldered to the corresponding circuit portion of the circuit board.

[Manufacturing Process of Mating Connector]

The mating connector 2 is manufactured by molding the housing 30 and the mating terminal 40 integrally using an upper mold and a lower mold (not shown). The upper mold and the lower mold are different molds from the molds used for molding the connector 1.

[Connection of Connectors]

Hereunder, operation for connection of the connector 1 and the mating connector 2 will be explained. First, the connector 1 and the mating connector 2 are soldered to the corresponding circuit portions of the circuit boards, respectively. Next, as shown in FIG. 2, the connector 1 is placed so that the receptacle recess portion 15 thereof opens toward the upper direction and the mating connector 2 is placed over the connector 1 so that the receptacle recess portion 35 thereof opens toward the lower direction. Next, the mating connector 2 is moved in the lower direction to insert the fitting portion of the mating connector 2 into the receptacle recess portion 15 of the connector 1.

Accordingly, the engaging portion 41 of the mating terminal 40 of the mating connector 2 moves pushing to open a space between the contact portion 22A and the locking portion 21A-1 of the terminal 20 of the connector 1. Then the elastic arm portion 22 is displaced elastically into the displacement receiving recess 12A as the contact portion 22A is pushed into the displacement receiving recess 12A. As the engaging portion 41 moves further, the contact portion 22A contacts with the corresponding contact portion 41A-1 of the engaging portion 41 with the contact pressure and the locking portion 21A-1 engages the locked portion 41B-1 of the engaging portion 41 in the vertical direction. Consequently, the terminals of the connectors are conducted electrically with each other as well as locking each other. Thereby, the operation for connection of the connectors is completed.

When the elastic arm portion 22 of the terminal 20 of the connector 1 is displaced in the displacement receiving recess 12A toward the protruding wall 12 as the connectors are connected to each other, the base portion 23 of the terminal 20 receives an external force having a component toward the protruding wall 12 in the short direction of the housing 10. As a result, the tapered portion 23A of the base portion 23 wedges toward the protruding wall 12 into a corresponding portion of the bottom wall 11 holding the tapered portion 23A. Thereby, it is possible to prevent the base portion 23 from coming off from the bottom wall 11.

In the embodiment, an upper surface of the tapered portion is situated in the same height with the upper surface of the bottom wall and exposed in the receptacle recess portion. The tapered portion may be buried entirely in the bottom wall without exposing the upper surface thereof. For example, the tapered portion may be buried entirely by having a downward slope from the side edge of the base portion, in other words, in a direction the tapered portion protrudes. Accordingly, the corresponding portion of the bottom wall blocks the tapered portion from moving in the upper direction by burying the tapered portion entirely in the bottom wall. As a result, it is possible to improve an effect of preventing the terminal from coming off, since the base portion does not come off from the bottom wall more certainly.

Second Embodiment

In a second embodiment of the present invention, the facing surfaces of the displacement receiving recess are not parallel to each other, while the facing surfaces are parallel to each other in the first embodiment. The facing surfaces are configured so as to be apart from each other toward the receptacle recess portion, in other words, toward the opening of the displacement receiving recess. In the embodiment, the configuration being different from the first embodiment will be explained mainly. Components similar to the first embodiment are designated with the same numeral references and explanations thereof will be omitted.

Figure 6:
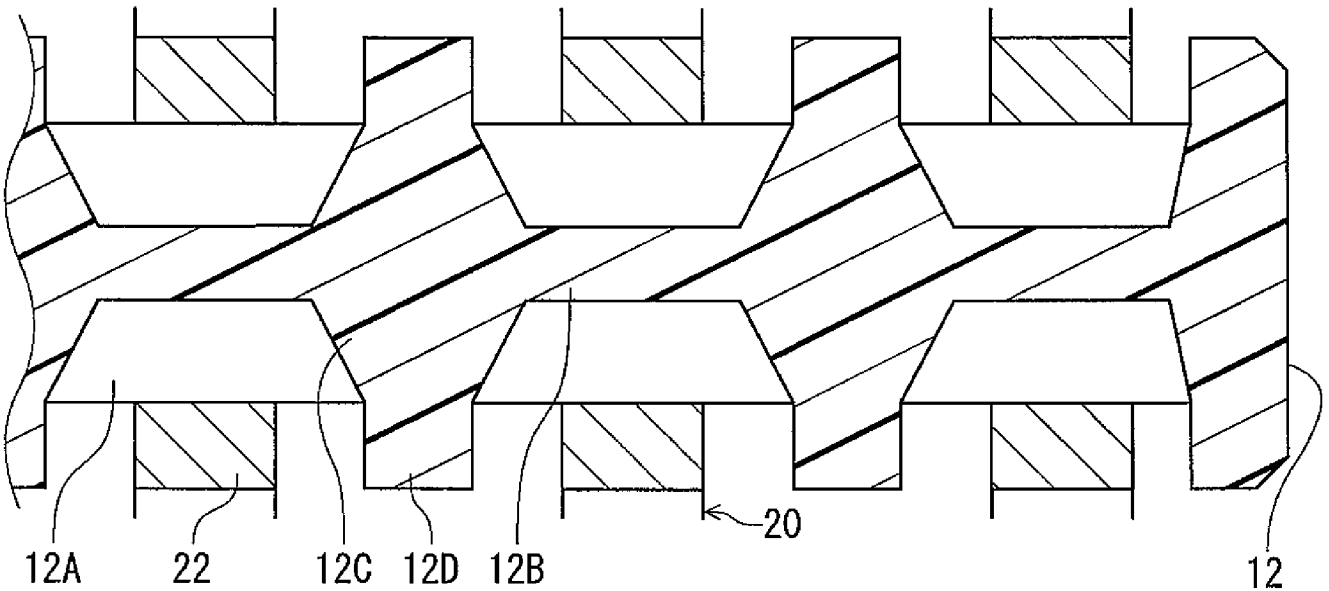
FIG. 6 is an enlarged sectional view partially showing an electrical connector around a protruding wall 12 thereof from an upper direction, according to a second embodiment of the present invention.

FIG. 6 is an enlarged sectional view showing the protruding wall 12 of the connector and a neighborhood thereof from an upper direction, according to the embodiment.

As shown in FIG. 6, in the embodiment, the facing surfaces of the displacement receiving recess 12A are apart from each other toward the receptacle recess portion 15 (refer to FIGS. 1 and 2) and have a tapered shape. According to having tapered facing surfaces as described above, it is possible to be easier to extract the lower mold from the displacement receiving recess 12A in the lower direction after the housing 10 and terminal 20 are molded integrally in the process of manufacturing the connector as compared to a case of the first embodiment having the facing surfaces parallel to each other.

Further, a distance between the facing surfaces is not steady in the short direction (a vertical direction in FIG. 6). Therefore, the lower mold is able to be made easier as compared to a case of having the facing surfaces parallel to each other, since it allows the lower mold to have an error in size to some extent at a portion thereof corresponding to the displacement receiving recess 12A.

Variation

In the first and the second embodiments of the present invention, each of the vertical wall portions of the protruding wall has the regulating protrusion. When the regulating protrusion has enough strength, it is not necessary to provide the regulating protrusion in every vertical wall portion. Arbitrary two or more of the vertical wall portions may include the regulating protrusions, respectively. As described above, it is also possible to regulate positioning of the mating connector satisfactorily when the regulating protrusions are provided in two or more the vertical wall portions.

In addition, it is possible to provide the regulating protrusion in the vertical wall portion situated at an end of the protruding wall in the longitudinal direction without providing the regulating protrusion in the vertical wall portion situated between the displacement receiving recesses adjacent to each other. As a result, it is possible to downsize the vertical wall portion not having the regulating protrusion in the longitudinal direction by not making the regulating protrusions. Consequently, it is possible to downsize the housing, eventually the connector, in the longitudinal direction.

The disclosure of Japanese Patent Application No. 2011-019581 filed on Feb. 1, 2011, is incorporated in the application by reference.

While the invention has been explained with reference to the specific embodiments of the invention, the explanation is illustrative and the invention is limited only by the appended claims.

What is claimed is:

1. An electrical connector to be connected to a mating connector, comprising:

a housing including a bottom wall portion, a protruding wall portion, and a hole portion, said protruding wall portion including a vertical wall portion and a recess portion, said hole portion penetrating the bottom wall portion and connected to the recess portion, said recess portion being recessed from the vertical wall portion toward a bottom surface thereof by a recessed depth; and a terminal disposed in the housing along a longitudinal direction of the housing, said terminal including a held section fixed to the housing and an elastic arm section, said elastic arm section having a base portion extending from the held portion, a contact portion disposed at a distal end portion thereof, and a transition portion between the base portion and the contact portion, wherein said base portion and the transition portion are situated outside the recess portion so that the transition portion is situated away from the bottom surface of the recess portion b at least the recessed depth in a deforming direction that the elastic arm section is deformed relative to the recess portion.

2. The electrical connector according to claim 1, wherein said protruding wall portion further includes a regulating protruding portion extending from the vertical wall portion in the deforming direction, said regulating protruding portion including a protruding top portion for contacting with the mating connector when the mating connector is connected to the electrical connector, said regulating protruding portion having a size smaller than that of the vertical well portion in the longitudinal direction.

3. The electrical connector according to claim 2, wherein said regulating protruding portion is disposed on at least two of the vertical wall portions.

4. The electrical connector according to claim 2, wherein said regulating protruding portion is disposed on at least the vertical wall portions located at both end portions of the housing in the longitudinal direction.

5. The electrical connector according to claim 2, wherein said regulating protruding portion is disposed on at least the vertical wall portions located at both end portions of the housing in the longitudinal direction and between the recess portions arranged adjacently.

6. The electrical connector according to claim 2, wherein said terminal is formed of a metal plate bent in a thickness direction thereof, said base portion being fixed to the bottom wall, said base portion including a tapered portion having a width decreasing toward the protruding wall portion so that the tapered portion is fixed to the bottom wall portion.

* * * * *